US006779849B1

(12) United States Patent
Harper et al.

(10) Patent No.: US 6,779,849 B1
(45) Date of Patent: Aug. 24, 2004

(54) MULTI-CHANNEL SLING SEAT FRAME

(75) Inventors: Alton Anderson Harper, Santa Ana, CA (US); Frederic Cone Doughty, South Pasadena, CA (US)

(73) Assignee: The Lane Company, Inc., Alta Vista, VA (US)

( * ) Notice: Subject to any disclaimer, the term of this patent is extended or adjusted under 35 U.S.C. 154(b) by 598 days.

(21) Appl. No.: 09/841,257

(22) Filed: Apr. 24, 2001

(51) Int. Cl.[7] ..... A47C 7/02

(52) U.S. Cl. ..... 297/452.13; 297/452.12; 297/452.2; 297/440.11

(58) Field of Search ..... 297/452.13, 452.12, 297/452.2, 440.11, 452.63

(56) References Cited

U.S. PATENT DOCUMENTS 3,041,109 A * 6/1962 Eames et al.
3,610,689 A * 10/1971 Smith
3,640,576 A 2/1972 Morrison et al. ..... 297/440
3,677,601 A 7/1972 Morrison et al. ..... 297/441
3,844,612 A 10/1974 Borggren et al. ..... 297/445
4,579,383 A * 4/1986 Colby
4,848,843 A 7/1989 Gibbs ..... 297/440
5,318,348 A 6/1994 Hess ..... 297/440.11
5,507,563 A * 4/1996 Arthur, Jr.
5,662,383 A 9/1997 Hand ..... 297/440.11
5,761,101 A * 2/1998 Frinier et al.
5,762,403 A 6/1998 Robinson ..... 297/440.11
5,911,478 A 6/1999 Goodman ..... 297/440.11
6,293,624 B1 * 9/2001 Gaylord et al.

FOREIGN PATENT DOCUMENTS

NL 80162829 * 7/1980

* cited by examiner

*Primary Examiner*—Rodney B. White
(74) *Attorney, Agent, or Firm*—Womble Carlyle Sandridge & Rice, PLLC

(57) ABSTRACT

The present invention is a sling frame member including a tubular rail and at least two channels formed within the tubular rail. Each of the channels is capable of receiving a sling. Also described herein is a furniture assembly having a set of seat sling rails of the present invention, a set of back sling rails of the present invention, and seat and back panels interconnecting the respective sets of sling rails to form a seating unit.

20 Claims, 5 Drawing Sheets

MULTI-CHANNEL SLING SEAT FRAME

FIELD OF THE INVENTION

The present invention relates generally to sling furniture of the type having a seat panel and backrest panel stretched across a rigid skeletal frame, and more specifically to an improved frame construction for sling furniture.

BACKGROUND OF THE INVENTION

"Sling furniture" is a popular style of furniture, and is characterized by incorporation of flexible material, also known as a "sling," that is fixed on opposite ends and supports a person sitting between the fixed ends. Generally, sling furniture is used for recreational, outdoor, or casual use. Thus, preferably, the frame is formed of material that is appropriate for temperature, moisture, and humidity fluctuations.

Sling furniture has a skeletal frame that defines the lateral edges of a seating unit. The unit may be a chair, a chaise lounge, a loveseat, or any other appropriate seating unit. The frame may be made of metal tubing, wood, plastic, or some other rigid material. A panel, or "sling," of some type of flexible but resilient material is disposed between the frame to provide comfortable seating and reclining.

Sling rails are sections of the frame along the lateral sides of the seating unit that are formed with a single channel to receive insertion of the sling. The sling can be woven or web material formed with lateral hem pockets. Flexible rods are inserted within the hem pockets of the sling and threaded through the sling rail channels. The sling is tautly stretched across the lateral edges of the frame to form the seat and backrest of the furniture. The rods and hem pockets are retained within the channel formed within the sling rail.

Sling furniture frames may include lateral supports extending across the frame. Due to the tautness of the sling or the location of the lateral supports, the lateral supports are designed to minimize any physical discomfort to the seated user. In other words, when a user is in a seated position, the stretched sling will not contort with the lateral supports if designed correctly. Visually, however, the lateral supports may be unattractive. Often the design of the frame provides for lateral support directly beneath the seat portion or directly behind the backrest portion. Thus, at certain angles, the lateral supports may disrupt the overall aesthetics of the seating unit. One solution is to provide lateral rails that are formed of a similar decorative motif as the rest of the frame. Unfortunately, however, this solution is not ideal due to the miscellaneous hardware that still must be used, such as attachment hardware or weld joints that remain exposed. For such reasons, a frame construction that hides the lateral support(s), the hardware, or the weld joints would be beneficial.

Another design feature of most sling rail seating is the use of "end caps." Often a cap is placed on the end of each seat and backrest sling rail to obscure the flexible rods and lateral hem pockets located within each sling rail channel. The end cap may be of any appropriate material, but generally end caps are made of plastic. Generally, however, sling furniture manufacturers would like to avoid the use of end caps due to their undesirable appearance. In other words, the use of end caps can detract from the overall appearance of the rest of the seating unit.

There is a need therefore for a sling furniture frame construction that presents a pleasing, finished appearance, with respect to lateral support members and end caps. Preferably, any such construction modification will not greatly complicate the manufacture of such furniture, either with respect to material cost, labor, or sling installation.

SUMMARY OF THE INVENTION

The present invention overcomes the deficiencies of the prior art by providing a sling frame member including a tubular rail and at least two channels formed within the tubular rail. Each of the channels is capable of receiving a sling. Thus, a furniture assembly having a set of seat sling rails of the present invention, a set of back sling rails of the present invention, and seat and back panels interconnecting the respective sets of sling rails will form a seating unit that presents a pleasing, finished appearance by obscuring frame hardware and obviates the need for end caps.

These and other aspects of the present invention as disclosed herein will become apparent to those skilled in the art after a reading of the following description of the preferred embodiments. The description is for the purpose of describing a preferred embodiment of the invention and is not intended to limit the present invention.

DETAILED DESCRIPTION OF THE PREFERRED EMBODIMENT

Figure 1:
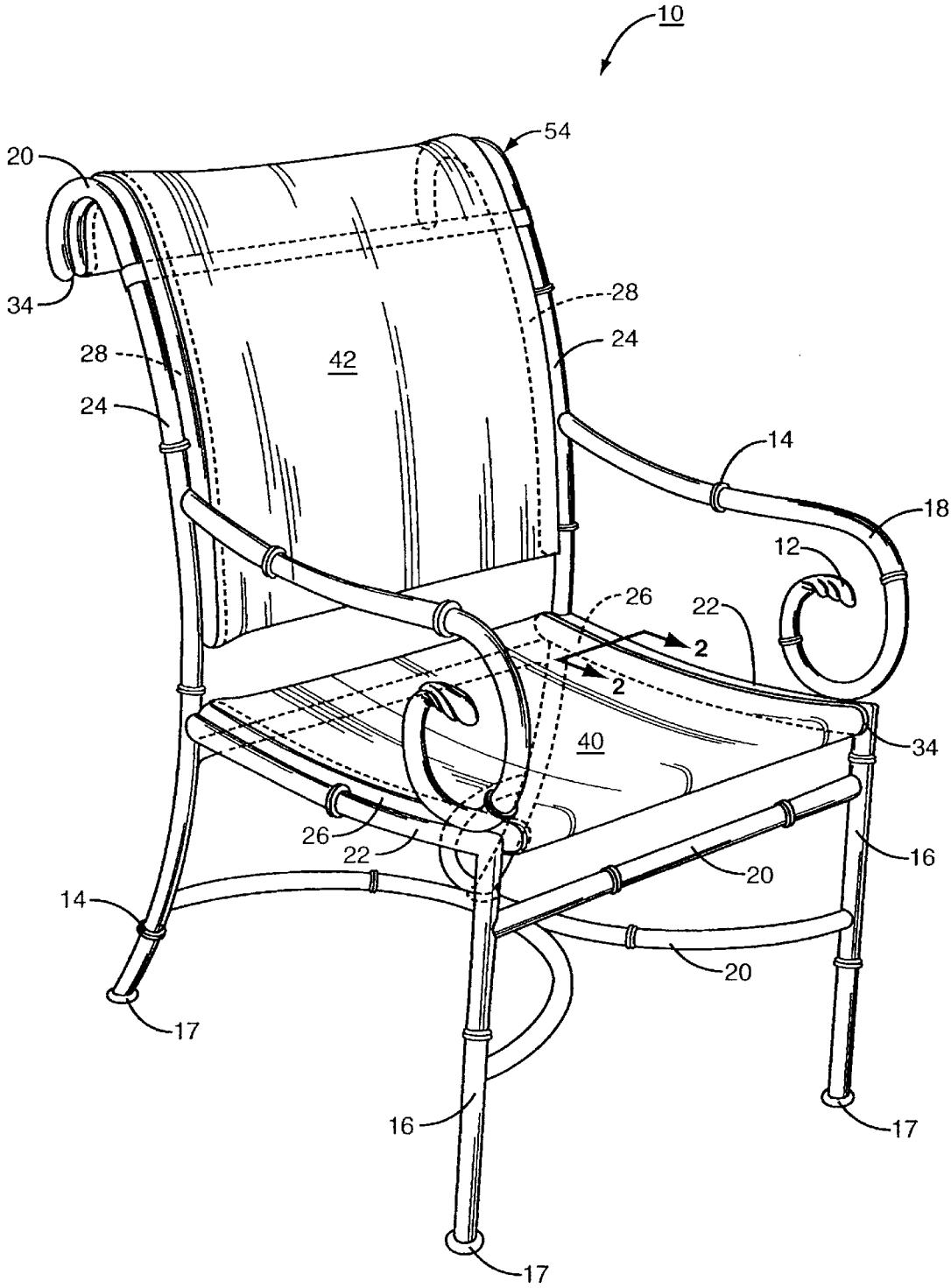
FIG. 1 is a top perspective view of a seating unit formed with the present invention.

The present invention is a novel construction for sling seating frames. Although the invention is described in conjunction with a chair frame 10, the invention should be interpreted to include other seating units, such as chaise lounges, loveseats, sofas, or other seating units.

As discussed above, sling seat frames generally are formed of metal tubing, wood, plastic, or other material suitable for outdoor use. For the present invention, the frame 10 preferably is formed of extruded aluminum tubing. For general use, preferably the tubing is either ⅞" or 1" round tubing. Any appropriate diameter or cross-sectional shape, however, may be used. Upon extrusion of continuous tubing, individual tubular components are cut to size and assembled, e.g., by welding, to form a rigid frame 10. Preferably, the frame 10 includes legs 16, arms 18, seat side frame rails 22, back frame rails 24, and lateral rails 20.

Optionally, in higher stress areas a tube within a tube construction may be used. Thus, a tube of smaller diameter is inserted inside the frame tubing in certain areas to increase strength. Decorative accents, such as the cast aluminum leaf 12 and/or faux bamboo rings 14 illustrated in FIG. 1, also may be welded onto the frame 10. Optional feet 17 are added to each leg by welding. The welded frame 10 is then cleaned and buffed in preparation for painting.

The above-described frame configuration is for use in explaining the preferred embodiment of the present invention and should not be used d to limit the scope of the present invention. Thus, the frame may incorporate any design configuration that incorporates the sling rails that are discussed below in more detail.

Figure 2:
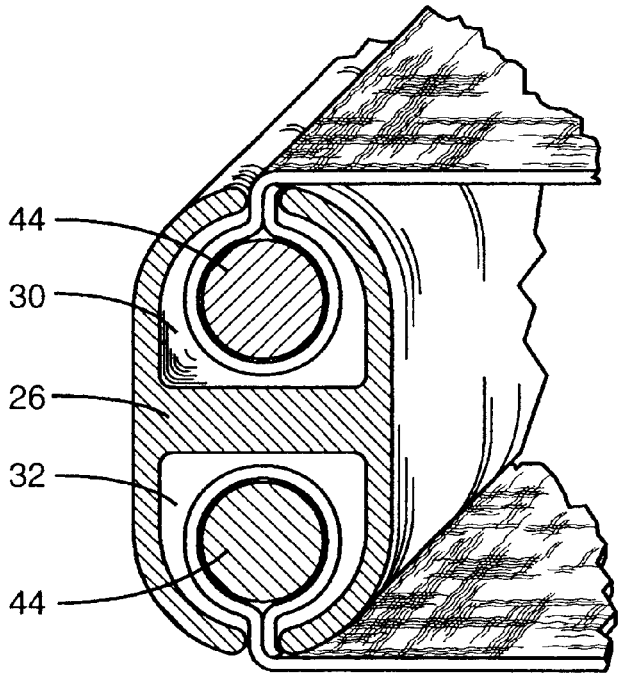
FIG. 2 is a cross-section view of the sling rails along the lines of 2—2 in FIG. 1.
Figure 3:
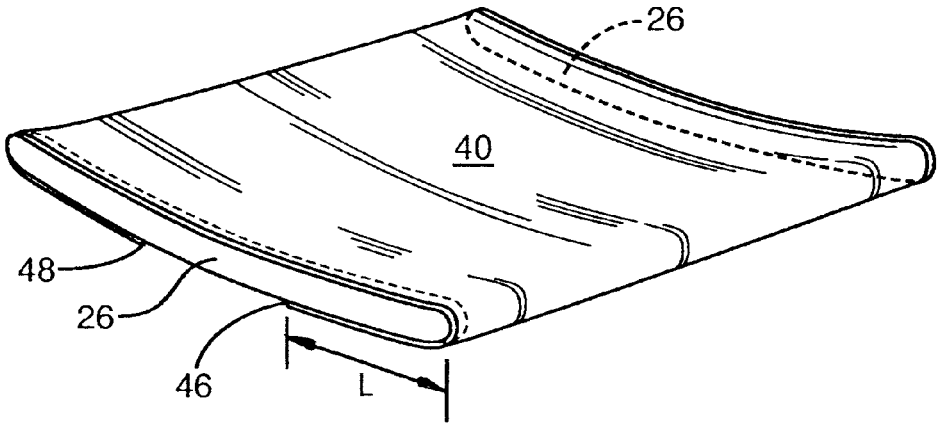
FIG. 3 is a partial exploded view of a section of the seating unit of the present invention.
Figure 4:
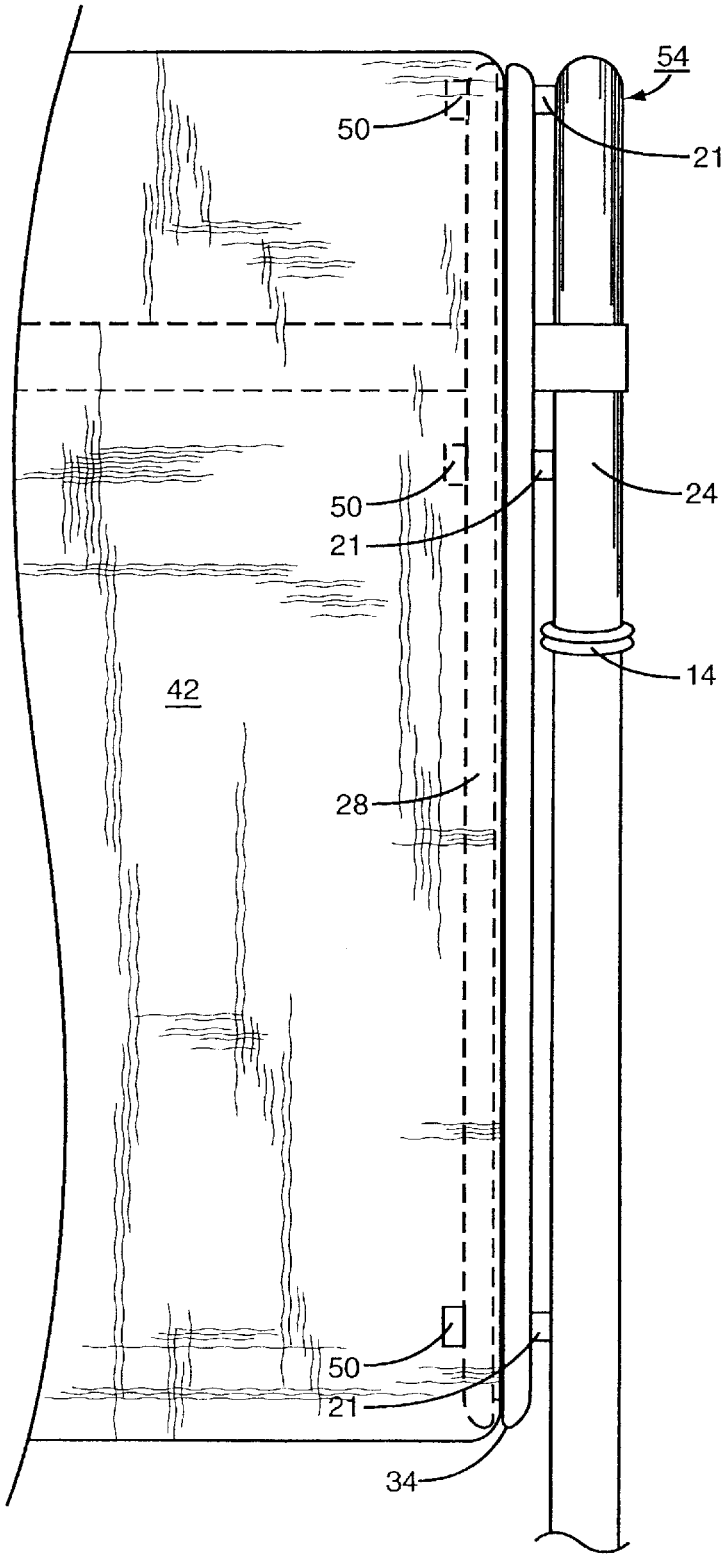
FIG. 4 is a partial exploded view of the back section of the seating unit of the present invention.
Figure 5:
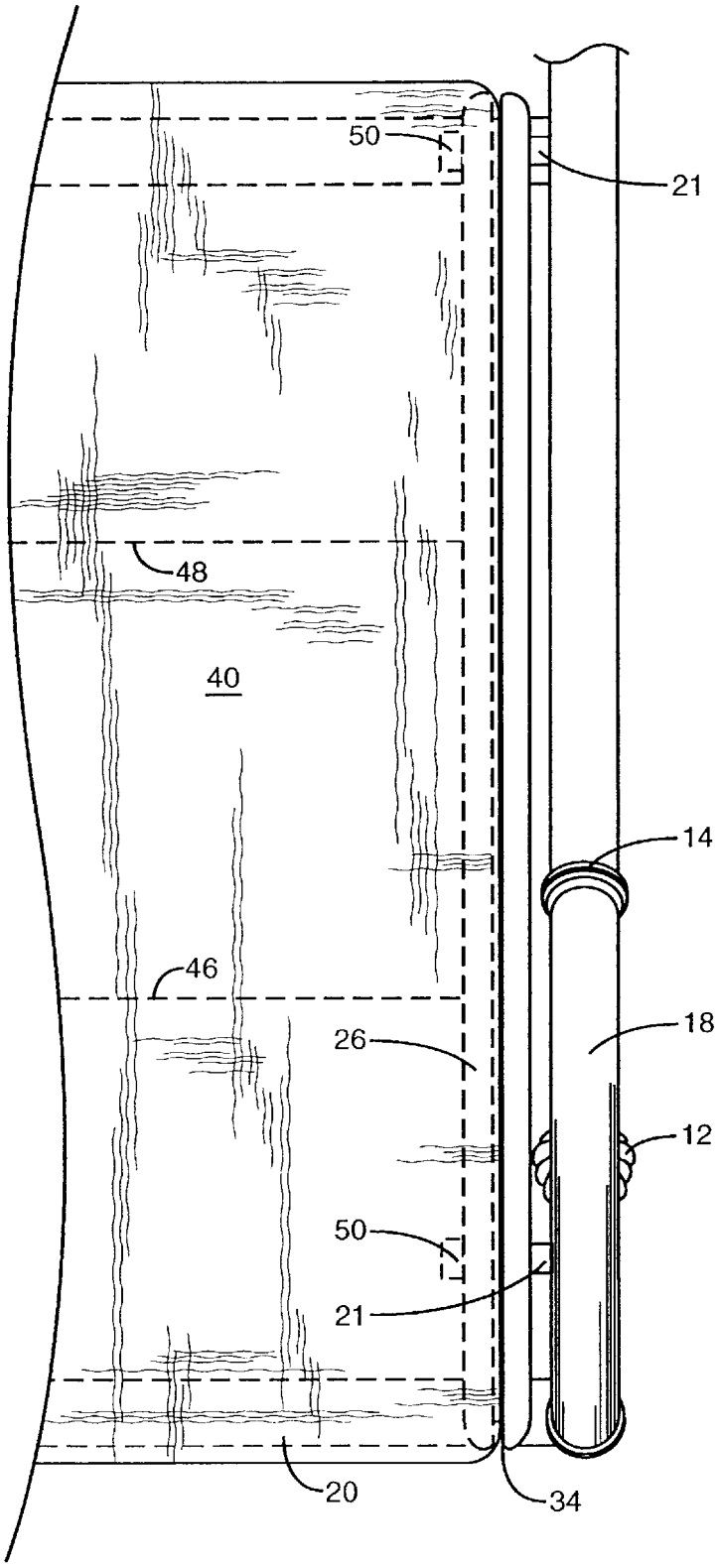
FIG. 5 is a partial exploded view of the seat section of the seating unit of the present invention.
Figure 6:
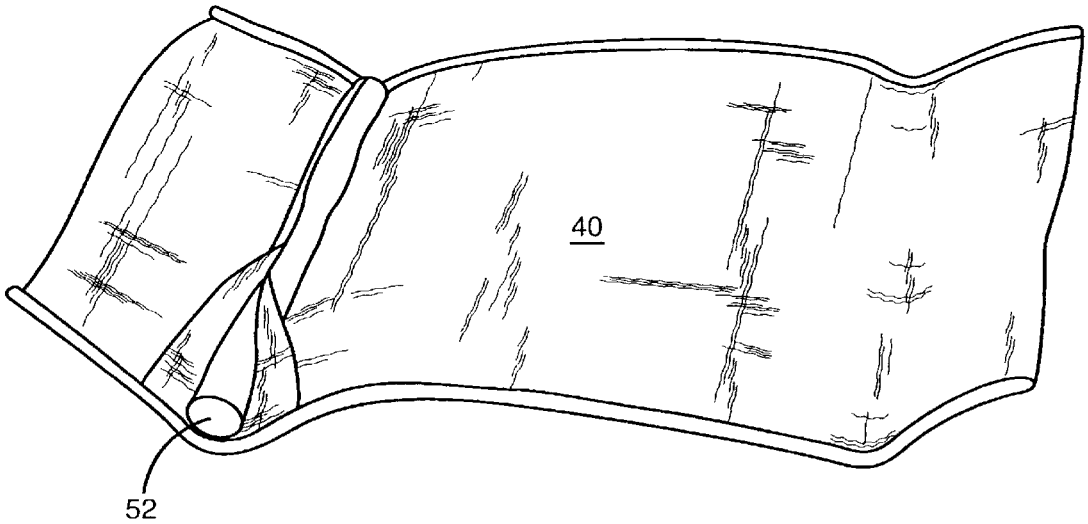
FIG. 6 shows a sling of the present invention.

The sling holders 26, 28 preferably are made from aluminum extrusion as well. As shown in FIG. 2, the sling rails 26, 28 are formed with at least two channels. As illustrated, the preferred configuration is two channels 30, 32, most preferably, diametrically opposed from one another. The channel configuration, however, may include more than two channels and may be in any desired spatial relationship. For example, the configuration may include three channels for placement of upper and lower fabrics within the slings as described in more detail below.

Multiple first coupling members 21, such as a nuts, are welded onto the inside surface of the seat side frame rails 22 and the back frame rails 24. The coupling members 21 are used to secure the respective sling rails 26, 28 to the frame rails 22, 24. Preferably, the sling rails 26, 28 are formed with a plurality of apertures through which second coupling members 50, such as screws, may be inserted therethrough for corresponding connection with the first coupling members 21 to secure the sling rails 26, 28 to the frame rails 22, 24.

As shown in FIG. 1, the lateral rails 20 may be welded straight across between the frame rails 22, 24 or in a decorative design such as conjoining semi-circles between the legs 16. Thus, the lateral rails 20 may be formed of a similar decorative pattern as the rest of the frame if the lateral rails are to be seen. If, however, it is preferred for the lateral rails to be obscured from view, the lateral rails may be welded to run directly between the sling rails 26, 28. As will be described in more detail below, the sling will obscure such lateral rails from view in the finished seating unit.

Similar to the frame rails 22, 24 described above, the sling rails 26, 28 preferably are extruded as continuous multi-channeled tubing. The individual sling rails 26, 28 then are cut to size. Preferably, each sling rail 26, 28 is formed with rounded ends 34. As will be described below, the rounded ends 34 allow the sling 40 to wrap around the end 34 of each sling rail 26, 28 during assembly. Thus, each sling rail 26, 28 preferably is a tubular rail having at least two channels 30, 32 formed therein. The sling rail 26, 28 has finished ends 34 that are aesthetically complimentary with the rail design. Thus, preferably, the finished ends 34 are integral with the tubular rail by being rounded and thereafter covered by the sling panel 40, 42. The finished ends, however, may be separate elements that are mountable to the ends 34 of the tubular rails 26, 28 to aesthetically complement the sling panel 40, 42.

The frame rails 22, 24 and the sling rails 26, 28 preferably are cleaned and buffed in preparation for painting. The individual rail pieces may be buffed and painted using any appropriate paint to create any desired design characteristics.

The fabric for the slings 40, 42 preferably is a blend of polyvinylchloride ("PVC") fibers and acrylic fibers. The blended fabric is preferred to provide a softer hand (or feel) than straight PVC fabrics. One preferred fabric is sold under the tradename LAMONT-CURRY by Glen Raven Mills of Glen Raven, N.C. The seat sling 40 and back sling 42 are made the same way. As illustrated in FIG. 1, one configuration of a seating unit of the present invention has separate slings for the seat 40 and the back 42. As will be appreciated by those skilled in the art, the frame may be configured to allow for a single, one-piece sling to provide both seat and back support.

Flexible plastic rods 44 are mounted to the fabric, such as by sewing into a hem on the left and right side of each sling 40, 42. Preferably, the top and bottom edge 46, 48 of each sling is hemmed as well for a preferred finished appearance. Also, preferably the sling is configured with a flexible but resilient lateral support 52, such as a foam spine, to provide support across the area approximately where a seated user's knees would be located.

The channels 30, 32 within the sling rails 26, 28 are configured to receive and retain a sling 40, 42. As described above, preferably the sling is formed with flexible rods 44 within left and right side hems. The rods 44 are insertable and remain within the channels 30, 32, especially upon stretching the sling panels 40, 42 by fastening the coupling members 21, 50. The invention, however, should not be limited to this particular sling configuration. The sling rails 26, 28 should be formed with appropriate channels 30, 32 to receive and retain the sling 40, 42 regardless of the particular sling configuration.

To install the preferred seat sling, multiple second coupling members 50, such as screws, are inserted through the sling rails 26 and mate with the first coupling members 21 on the inside of the seat side rails 22. Preferably, the respective coupling members 21, 50 are not completely secured to one another until the sling 40, 42 has been loaded within the sling rails 26, 28.

The sling 40 can be loaded into the sling rails 26 from either open end. The fabric-enclosed plastic rod 44 is inserted into a first channel 30 of each sling rail 26. The sling 40 is pulled through channel 30 and then loaded into a second channel 32. Preferably, the sling 40 is of sufficient length to allow sling 40 to be loaded into second channel 32 from each open end. The sling 40 is pulled through the second channel 32 until relatively taut.

As noted above, the sling rails 26 are formed with at least two channels. The preferred embodiment as herein described has two channels 30, 32. Additional channels may be desired, however, and the sling fabric would be inserted similar to that described above wherein a flexible rod mounted to the sling is drawn through respective sling rail channels. As briefly described above, a frame may be formed with more than two channels so as to provide for multiple sling layers to be installed to the frame. Such multiple layers would allow for, e.g., outer slings, potentially removable, that are made from more weather-durable materials to protect less durable, but more decorative, fabric slings.

The sling fabric 40, 42 is pulled taut on top and bottom and rolled smooth around each end of the sling rails 26, 28. The second coupling members 50 should then be secured with their respective first coupling members 21 to stretch the fabric to a finished state and provide a smooth seating surface.

The sling 40 masks the mated first 21 and second 50 coupling members, so the coupled members are hidden from view from the top and front of the chair. Thus, the sling 40 should be of sufficient length as to wrap about the ends of the respective sling rails. Preferably, the sling 40 is of such length L as to extend approximately ⅓ the depth of the seat toward the center from the end. As one skilled in the art will appreciate, should the seating unit include lateral supports, the slings 40, 42 should be formed of sufficient length as to mask those lateral supports as well.

As shown in FIG. 1, one preferred back frame design includes a rearwardly curving top portion 54. For this preferred back portion design, preferably the sling 42 is loaded from the bottom of the back sling rails 28. The flexible rods 44 within sling 42 are loaded into the first channel 30 of each of the respective back sling rails 28. For the embodiment illustrated in FIG. 1, the sling 42 is pulled upwardly over the front of the back and pulled around the curve 54 at the top of the chair.

The flexible rods 44 within the sling 42 are then loaded into the respective second channels 32 of the back sling rails 28 at the top and pulled down to an appropriate distance to obscure the end hem from view, such as the middle of the underside of the curve 54. The flexible rods 44 or the sling 42 are then loaded into the respective second channels 32 of the back sling rails 28 at the bottom of the back and pulled up the rear side toward the top 54. Preferably, the sling 42 is not pulled to abut its opposite end. Rather, an opening is left between the ends of the sling 42 under the curve 54 of the chair so that the coupling members 21, 50 can be mated and secured to one another. Preferably, the sling 42 is pulled such that the opening and the coupling members 21, 50 cannot be seen from the back or the top of the piece. Thus, preferably, the opening is at or near the crux of the top curve 54.

Similar to the seat described above, the back sling 42 is pulled taut front and back and rolled smooth around each end of the sling rails 28. The coupling members 21, 50 are tightened to stretch the fabric and provide a smooth seating surface.

As will be appreciated by those skilled in the art, the frame may be formed of any shape and the present invention should not be limited to a seat with a curved back as herein described as the preferred embodiment. The multiple channel sling frame allows for the sling fabric to cover the frame hardware regardless of the design. Thus, for example, if the seat had a straight back, the sling could meet at a location near the bottom of the back to cover the back hardware from view while maintaining the aesthetic appearance of the seat.

Although specific embodiments of the present invention have been illustrated and described in detail, it is to be expressly understood that the invention is not limited thereto. The above detailed description of the embodiment is provided for example only and should not be construed as constituting any limitation of the invention. Modifications will be obvious to those skilled in the art, and all modifications that do not depart from the spirit of the invention are intended to be included within the scope of the appended claims.

What is claimed is:

1. A sling frame assembly comprising:

at least two rails;

at least two channels on each of the at least two rails; and at least one panel disposed between the at least two rails whereby a portion of the at least two channels on each rail receives and retains the panel.

2. The sling frame assembly of claim 1 further comprising:

a plurality of mounting elements for securing the rails to a seat frame.

3. The sling frame assembly of claim 1 wherein the rails include finished ends, wherein the finished ends are aesthetically complimentary with the rails.

4. The sling frame assembly of claim 3 wherein the finished ends are integral with the rails.

5. The sling frame assembly of claim 1 wherein the at least two channels are diametrically opposed.

6. A furniture assembly comprising:

a set of seat sling rails, each seat sling rail having at least two channels therethrough;

a seat panel interconnecting the set of seat sling rails wherein the seat panel is received and retained within at least a portion of each of the at least two channels on each seat sling rail;

a set of back sling rails, each back sling rail having at least two channels therethrough; and a back panel interconnecting the set of back sling rails wherein the back panel is received and retained within at least a portion of each of the at least two channels on each back sling rail:

wherein the back sling rails are associated with the seat sling rails such that the back panel forms a seat back to the seat panel.

7. The sling furniture assembly of claim 6, wherein the seat panel comprises a single, continuous panel and the back panel comprises a single, continuous panel.

8. The sling furniture assembly of claim 6 further comprising:

a set of side frame rails, to correspond with and support the seat sling rails;

a vertical support structure to support the side frame rails;

at least one lateral support extending substantially perpendicular to the vertical support structure; and a set of back frame rails extending upwardly from the side frame rails, to correspond with and support the back sling rails.

9. The sling furniture of claim 8 wherein the vertical support structure comprises:

a set of front legs;

a set of back legs; and wherein the at least one lateral support comprises a set of lateral rails extending between the front and back legs.

10. The sling furniture of claim 8 further comprising:

an arm extending substantially perpendicularly from the back frame rails and substantially parallel with the side frame rails.

11. The sling furniture of claim 6 wherein respective seat sling rails and back sling rails are comprised of a continuous rail.

12. The sling furniture of claim 11 wherein the seat panel and back panel are a one-piece panel.

13. The sling furniture of claim 6 wherein the sling rails are extruded aluminum tubing.

14. The sling furniture of claim 6 wherein each seat and back sling rail has two diametrically opposed channels.

15. The sling furniture of claim 6 further comprising:

a plurality of coupling members to secure the sling rails to corresponding frame rails wherein the seat panel and back panel extending within the channels of the seat sling rails partially visually obscures the plurality of coupling members.

16. A method for assembling furniture comprising:

inserting a sling into a first channel within a sling rail of a frame;

guiding the sling through the first channel;

inserting the sling into. a second channel within the sling rail;

guiding the sling through the second channel;

stretching the sling taut within the frame.

17. The method of claim 16 wherein the first channel is located on top of the sling rail and the second channel is located on the bottom of the sling rail and the sling extends over the sling rail end.

18. The method of claim 16 further comprising:

inserting the sling into next consecutive channels within the sling rail;

guiding the sling through the next consecutive channels.

19. A furniture assembly comprising:

(a) a set of seat sling rails, each seat sling rail having two diametrically opposed channels therethrough;

(b) a seat panel interconnecting the set of seat sling rails wherein the seat panel extends within each channel;

(c) a set of side frame rails, to correspond with and support the seat sling rails;

(d) a vertical support structure to support the side frame rails, the vertical support structure further comprising:

(i) a set of front legs;

(ii) a set of rear legs;

(iii) at least one lateral support extending between the sets of front and rear legs;

(e) a set of back sling rails, each back sling rail having two diametrically opposed channels therethrough;

(f) a back panel interconnecting the set of back sling rails wherein the back panel extends within each channel;

(g) a set of back frame rails to correspond with and support the back sling rails, wherein the back frame rails extend upwardly from the side frame rails such that the back panel forms a seatback to the seat panel.

20. The sling frame assembly of claim 1, wherein the panel comprises a single, continuous panel.

* * * * *